US005174395A

United States Patent [19]

Potvin

[11] Patent Number: 5,174,395

[45] Date of Patent: Dec. 29, 1992

[54] IN-THE-HOLE DRILL INNER TUBE ROD

[75] Inventor: Gerald J. Potvin, Sudbury, Canada

[73] Assignee: Inco Limited, Canada

[21] Appl. No.: 759,264

[22] Filed: Sep. 13, 1991

[51] Int. Cl.[5] ..... E21B 17/16

[52] U.S. Cl. ..... 175/320

[58] Field of Search ..... 175/296, 320, 324

[56] References Cited

U.S. PATENT DOCUMENTS 2,958,512 11/1960 Humphrey ..... 175/320 X 3,047,313 7/1962 Bruce ..... 175/320 X 4,872,519 10/1989 Kopecki ..... 175/320

*Primary Examiner*—William P. Neuder

*Attorney, Agent, or Firm*—Edward A. Steen; Blake T. Biederman

[57] ABSTRACT

A drill rod having an inner tube extending through the rod. The rod and the tube form a dead zone that reduces the time necesssary to compress air within the rod. By presenting a smaller internal cross-sectional flow area within the rod and, as a consequence throughout the drill string, the drill hammer disposed at the bottom of the hole will operate more efficiently.

5 Claims, 1 Drawing Sheet

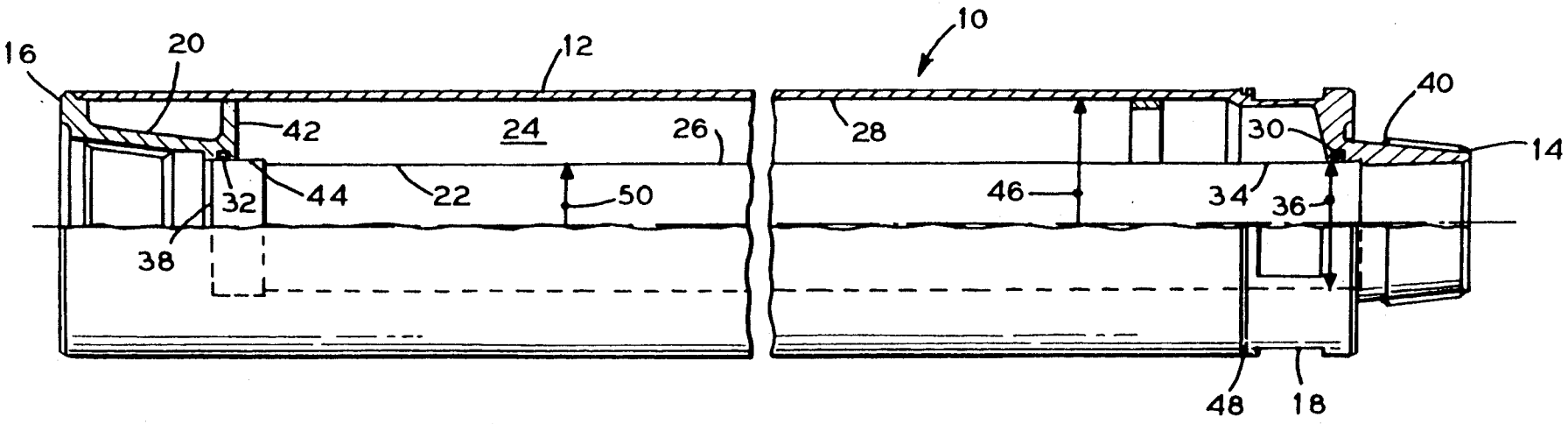
14
40
30
36
34
18
48
46
10
28
26
50
12
24
22
42
44
32
20
38
16

IN-THE-HOLE DRILL INNER TUBE ROD

TECHNICAL FIELD

The instant invention relates to drill rods in general, and more particularly to a drill rod liner adapted to substantially reduce the time and effort required to recharge a compressed air powered drill string.

BACKGROUND ART

In many instances, both at surface locations and underground excavations, holes are bored into the underlying surface using in-the-hole ("ITH") or down-the-hole ("DTH") drilling techniques.

ITH drilling is accomplished by employing a pneumatic hammer disposed in the hole bottom at the end of a string of drill pipe. The drill pipe string consists of a plurality of interconnected drill rod sections extending into the hole. The pneumatic hammer and its associated drill bit are attached to the bottom end of the string directly against the bottom of the hole. The hollow drill pipe serves as a conduit for compressed air, supplied at the surface, to be fed to the hammer. The air, typically pressurized to about 270–330 pounds per square inch (1.9–2.3 MPa) and entrained with oil, operates the hammer.

Typically, the standard drill rod is a little over 5 feet (1.5 m) long and 6.5 inches (16.6 cm) in outside diameter. One end of the rod includes a threaded male pin. The opposite end includes a threaded female box. The rods are configured so that a pin end fits into an adjacent box end thereby building up the drill string.

After the hole is drilled a predetermined amount, an additional rod must be added to the string. Every time the string is extended, the drilling process must be interrupted. The cuttings about the hammer must be blown out and up between exterior of the pipe and the bore wall. The compressed air within the string must then be bled out safely so the top connection can be broken in order to add an additional rod.

After the new rod is attached, the string must be recharged with compressed air. A drill string 200–300 feet (61–91 m) long may take up to two minutes or more to be fully charged.

During this lag time, however, the hammer immediately begins to operate by reciprocally driving the hammer piston against the drill bit. Hammers are designed to efficiently operate at the previously mentioned pressures of 270–330 psi (1.9–2.3 MPa). As the air pressure begins to slowly increase the hammer piston commences to strike the bit with insufficient energy to break the rock. This ineffectual flailing action generates debilitating heat. Without the proper air pressure, the cooling/lubricating effect of the air/oil mixture is reduced. The cutter temperature may rise in excess of 180° F. (82.2° C.). Although not yet fully operational, this early inefficient percussion causes the tool to expand. Expansion sometimes causes the carbide cutter buttons to fall off. Unfortunately, there is no equipment currently available to disable the hammer until the pressure comes up to standard.

Each time the string is extended, undesirable drilling inefficiencies are added to the operation. Time delay, increased bit wear, hole inaccuracy and additional maintenance add to the expense of drilling deep holes.

SUMMARY OF THE INVENTION

Accordingly, there is provided an inner tube lining to reduce the internal cross-sectional area of the rod. The liner is inserted into the rod so as to cause a relatively smooth bore extending through the entire rod.

BRIEF DESCRIPTION OF THE DRAWING

The FIGURE is a sectional view of an embodiment of the invention.

PREFERRED MODE FOR CARRYING OUT THE INVENTION

Referring to the FIGURE, there is shown a drill rod 10. The rod includes a midsection 12 bookended by a threaded pin connection 14 and a threaded box connection 16. The pin and box connections 14 and 16 are designed to mate with their respective associated components on an adjacent rod 10 or other component so as to generate an end-to-end extended drill string. Wear groove 48 indicates the condition of the rod 10.

Connections between adjacent rods 10 are made and broken by positioning conventional tools (not shown) in the pin tool joint 18 and the box tool joint 20. These joints are depressed sections adapted to restrain the tool as it holds or rotates the rod 10.

In order to reduce the need and time for air compression, an inner tube 22 is disposed within the rod 10. An annular void or dead zone 24 is formed between the wall 26 of the tube 22 and the wall 28 of the rod 10. Two O-rings 30 and 32 position the tube 22 in place. A Smalley TM VH-325 snap ring 38 retains the tube 22 within the rod 10.

It is preferred to align the tube wall 26 with the pin and box connections 14 and 16 so as to form a substantially continuous inner flow surface 34. This may be done by sizing the diameter of the tube 22 to be approximately the same as the internal diameter 36 taken along the shoulders 40 or 42 of the midsection 12. By choosing this sizing arrangement, the internal cross-sectional flow area of the string is relatively smooth.

For non-limiting discussion purposes only, typical dimensions are given. However, it will be understood that other dimensioned components fall with the scope of the instant invention.

A typical drill rod 10 is 62 inches (1.6 meters) long and 6.5 inches (16.5 cm) in outside diameter. The pin connection 14 is 2 inches (51 mm) long. The rod wall 28 is 0.19 inches (4.9 mm) thick.

In order to present a relatively flush internal cross-sectional flow area, the inner diameter of the tube 22 should be approximately 3 inches (76.2 mm)—similar to the diameter 36. The tube is 56.4 inches (1.4 m) long.

In order to fabricate the instant invention, the tube 22 is inserted into the rod 10 from the box connection 16 end until it meets the shoulder 40. Before the tube 22 is installed, the distal (box) end may be slightly expanded 44, using a hydraulic expanding tool so as to insure a tight press fit assembly within the rod 10. The O-rings 30 and 32 provide a pressure tight seal so as to prevent air leakage. The retaining ring 38 stabilizes the assembly. Previous to the installation of the O-rings 30 and 32, small grooves are machined into the wall of the rod 10 to accommodate the rings. The retaining ring 38 is similarly situated.

By employing the tube 22, the effective cross-sectional area of the drill rod 10 is reduced. For example:

Assume the radius 46 of the drill rod 10 is 3 inches (7.6 cm); the radius 50 of the tube 22 is 1.5 inches (0.6 cm); and the length of the tube 22 (which is also approximately the length of the midsection 12) is 56.4 inches (143 cm).

$$\text{Area of the Zone 24} = \pi(r_1^2 - r_2^2) = \pi(3^2 - 1.5^2)$$
$$= 21 \text{ inches}^2 (136 \text{ cm}^2)$$
$$\text{Volume of the Zone 24} = (56.4 \text{ inches})(21 \text{ inches}^2)$$
$$0.69 \text{ ft}^3 \ (0.0194 \text{ m}^3)$$

The calculated zone 24 volume approximately represents the reduction in rod volume caused by the tube 22. This number multiplied by the number of rods 10 in a drill string represents the volume that no longer has to be charged and discharged every time an additional rod is attached to the string. Not only is the lag time reduced, but the flush internal flow surfaces allow for a more efficient streamlined air flow down to the hammer.

During drilling operations, at least one of the drill rods 10 would be affixed to a drilling apparatus, typically a fluid driven pressure hammer. Oil laden compressed air is introduced through the tube 22 to the hammer. A hydraulic system is an alternative. As the hammer operates, cuttings are routed away from the hammer and up to the surface between the wall of the bore and the outer wall of the rod 10. No cuttings are routed up through the interior of the rods in this form of ITH drilling.

After a predetermined distance, the system is decompressed and another rod 10 added to the lengthening drill string. The system is re-energized with compressed air. However, due to relatively smooth, continuous and smaller internal cross-sectional area of the rods 10, the time to get the drill string and hammer up to speed is substantially reduced. The hammer is efficiently operated much sooner than before reducing waste generation and maintenance costs.

Faster pressure build up results in more feet drilled per unit time. Since less air is consumed, the loads on the compressors are reduced. With increased pressure delivery the hole will be cleaner. A clean hole results in fewer stuck rods. Moreover, the rod is stronger since the tube also becomes an additional inner support.

Even though the rods will be somewhat heavier (approximately 4 pounds [1.8 kg]) and more difficult to cut when stuck, the increased efficiencies engendered by the tube outweigh these relatively minor difficulties.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A drilling apparatus, the apparatus comprising a drill rod, means for attaching the rod to an adjacent member, a tube disposed within the drill rod briding the proximal and distal ends of the drill rod, an annular empty dead zone disposed between the internal wall of the drill rod and the external wall of the tube, and the rod including a substantially constant cross-sectional flow area therein.

2. The apparatus according to claim 1 connected to a mining tool.

3. In combination with a drill rod, the rod comprising an elongated cylindrical midsection, male threaded means affixed to one end of the midsection, female threaded means affixed to the opposed end of the midsection, a tube disposed within the midsection, an empty dead zone between the tube and the inner wall of the midsection, and the rod including a substantially constant cross-sectional flow area therein.

4. The combination according to claim 3 wherein grasping means attach the tube to the interior of the rod.

5. The combination according to claim 3 including a wear groove circumscribing the rod.

* * * * *